US009161885B1

(12) United States Patent
Zhou

(10) Patent No.: US 9,161,885 B1
(45) Date of Patent: Oct. 20, 2015

(54) SELF LEARNING MEDICATION STORAGE DEVICE

(71) Applicant: Wesley Zhou, Aliso Viejo, CA (US)

(72) Inventor: Wesley Zhou, Aliso Viejo, CA (US)

( * ) Notice: Subject to any disclaimer, the term of this patent is extended or adjusted under 35 U.S.C. 154(b) by 23 days.

(21) Appl. No.: 14/272,377

(22) Filed: May 7, 2014

(51) Int. Cl.

| | |
|---|---|
| ***G08B 21/00*** | (2006.01) |
| ***B65D 25/04*** | (2006.01) |
| ***B65D 43/14*** | (2006.01) |
| ***A61J 1/03*** | (2006.01) |
| ***A61J 7/00*** | (2006.01) |
| ***G08B 21/24*** | (2006.01) |

(52) U.S. Cl.
CPC *A61J 7/0418* (2015.05); *A61J 1/03* (2013.01); *A61J 7/0076* (2013.01); *B65D 25/04* (2013.01); *B65D 43/14* (2013.01); *G08B 21/24* (2013.01)

(58) Field of Classification Search
CPC ..... A61J 7/04; A61J 7/0409
USPC ..... 340/309.7, 573.1; 221/2; 368/10; 206/534
See application file for complete search history.

(56) References Cited

U.S. PATENT DOCUMENTS

| | | | | |
|---|---|---|---|---|
| 5,099,463 | A * | 3/1992 | Lloyd et al. | 368/10 |
| 5,200,891 | A * | 4/1993 | Kehr et al. | 221/2 |
| 2010/0314282 | A1 * | 12/2010 | Bowers | 206/534 |

* cited by examiner

*Primary Examiner* — Jeffery Hofsass
(74) *Attorney, Agent, or Firm* — Greenberg Traurig LLP; Franklin D. Ubell

(57) ABSTRACT

Compartments of a medication storage device are fitted with sensors to detect the presence of medication and the opening of compartment lids or doors. A controller monitors the sensor signals and sounds an alarm if medication is not removed from a compartment within a variance range about a target time.

4 Claims, 6 Drawing Sheets

SELF LEARNING MEDICATION STORAGE DEVICE

BACKGROUND OF THE INVENTION

1. Field of the Disclosure

The subject disclosure relates to a self-learning medication dispenser device that will remind the user with an alarm in case the user has not taken medication within a certain block of time around a target time for taking the medication.

2. Related Art

Medication storage boxes for storing pills have been devised in the past.

SUMMARY

The following is a summary of description of illustrative embodiments of a self-learning medication storage device that tracks user's activity and provides an alarm or alert if the user has not taken his medication within a selected time interval. It is provided as a preface to assist those skilled in the art to more rapidly assimilate the detailed design discussion which ensues and is not intended in any way to limit the scope of the claims which are appended hereto in order to particularly point out the invention.

A device according to an illustrative embodiment has seven compartments that each can hold medication for the user. Each compartment has a built-in sensor that detects if any medication is present or if the compartment is empty. A door or lid switch may also be provided to detect whether if the compartment door or lid is open or closed. In one embodiment, the first compartment is for Sunday, the second for Monday etc., all the way to the seventh compartment for Saturday. Various embodiments may additionally include an optional electronically programmable locking system on each of the compartments, for example, to keep users from accidentally overmedicating.

According to an illustrative implementation, after filling the compartments, the user begins taking his medication at the prescribed time each day. Beginning with the first day the user uses the device, the device logs the time that the user takes the medication each day and, based on this stored information, the device calculates a "target time" for the medication with a variance window before and after this target time. If the medication in the next compartment is not completely removed within this variance window after the target time, the device warns the user with an alarm/reminder.

In one embodiment, if the user needs medication in the morning and in the evening, he or she may connect two of the devices together and use the first device for the morning medication, and the second device for the evening medication. The user can connect as many of the devices together as needed. In one embodiment, the devices do not interact with each other; i.e., each will be for a dedicated medication time regimen (morning, afternoon, evening, before bed, etc.)

DETAILED DESCRIPTION

Figure 1:
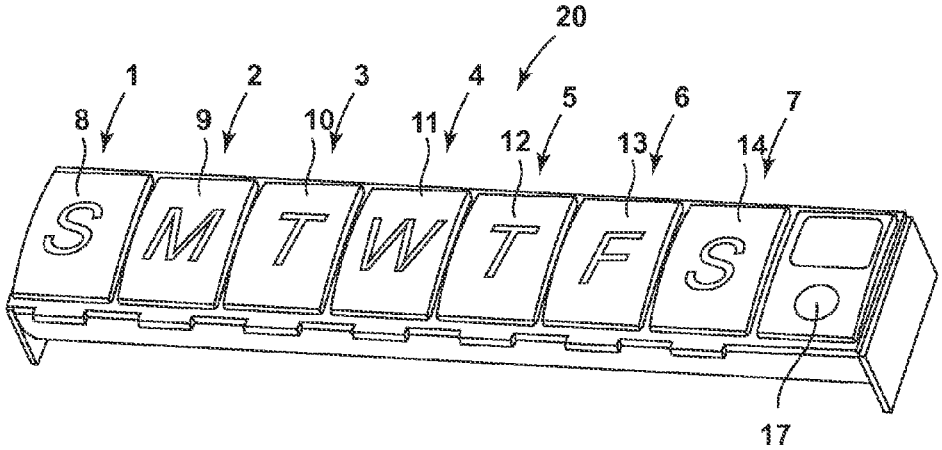
FIG. 1 is a perspective view of an illustrative embodiment of a medication dispenser.

As shown in FIG. 1, an illustrative self-learning medication storage device 20 has seven compartments 1-7, each with a movable cover 8-14, which may be opened to allow insertion and removal of medication such as pills or capsules from each compartment. In one embodiment, the movable compartment cover may be a "door" which slides in and out to open or close a compartment. In another embodiment, the movable compartment cover may be a hinged lid. In the illustrative embodiment discussed hereafter, the movable compartment covers are slidable doors and will be referenced to hereinafter simply as "doors 8-14."

Each compartment 1-7 further has a built-in sensor, e.g. 31 (FIG. 2) that will detect if any medication is present. Each compartment 1-7 may also have a door sensor, e.g. 34, which provides a signal that indicates whether one of the doors 8-14 is opened or not.

The illustrative device 20 has one or more control buttons on an alarm button panel 17 that can be located on the side or on the bottom or top of the device 20. The electronic circuitry, battery 19, and alarm buzzer 20 (FIG. 5) can be located anywhere on the device 20.

Figure 2:
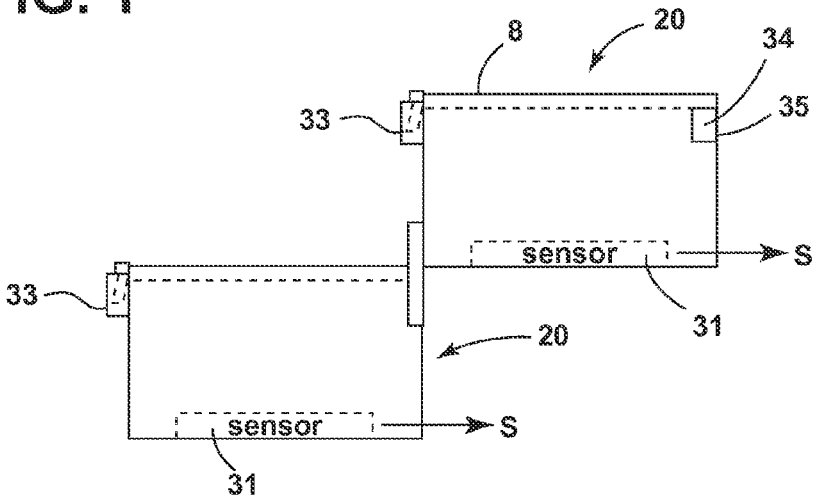
FIG. 2 is a side schematic view of cascaded medication dispensers of an illustrative embodiment with lids closed.
Figure 3:
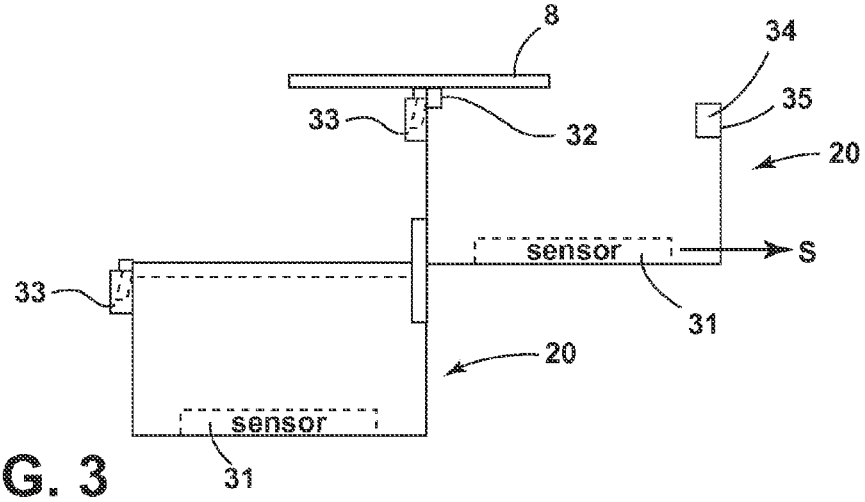
FIG. 3 is a side schematic view of cascaded medication dispensers of an illustrative embodiment with lids opened.
Figure 5:
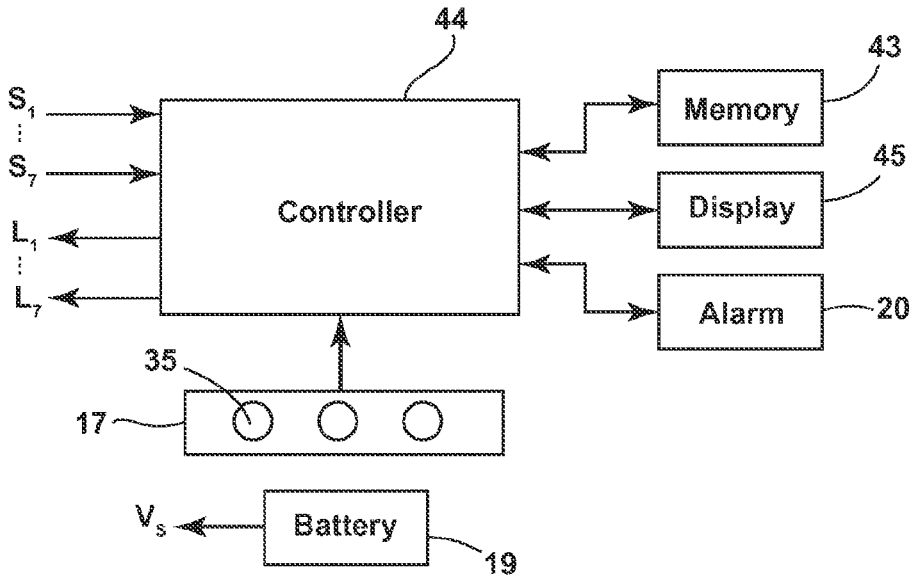
FIG. 5 is a circuit schematic diagram illustrative of electronic componentry of an illustrative medication dispenser embodiment.
Figure 6:
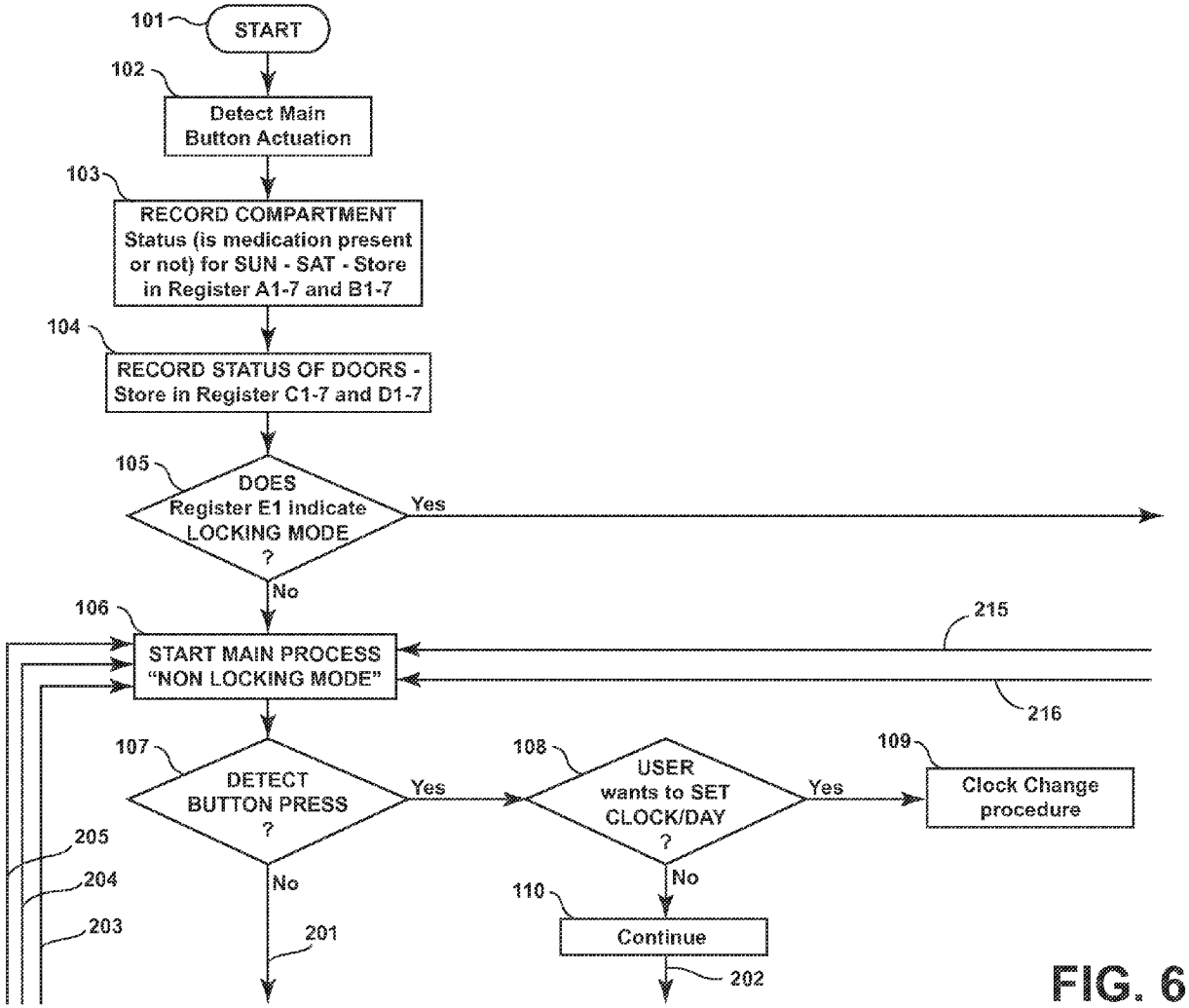
FIG. 6 is part of a flow diagram illustrative of operation of an illustrative embodiment.

In one embodiment, as shown in FIG. 2, the doors, e.g. 8, may slide in and out horizontally and may optionally be locked in place by respective electromagnetic cylinder locks 33, which can be released, for example, upon activation of the device by depressing an ON-OFF button 35 (FIG. 5). Such sliding action can be achieved, for example, by forming edges on the respective sides of the door 8 which can slide in grooves formed in the side walls of the pill compartments ("tongue and groove"), or in other manners, and whose length of extension may be determined by the position of a suitable stop 32. Alternatively, the compartment doors, e.g., 8, can pivotally attach to the back edge 35 of a medication container and can be configured to snap open and shut. In various embodiments, the sensors 31 may comprise coated-on electrical touch sensors, electrostatic sensors, or optical sensors.

Figure 4:
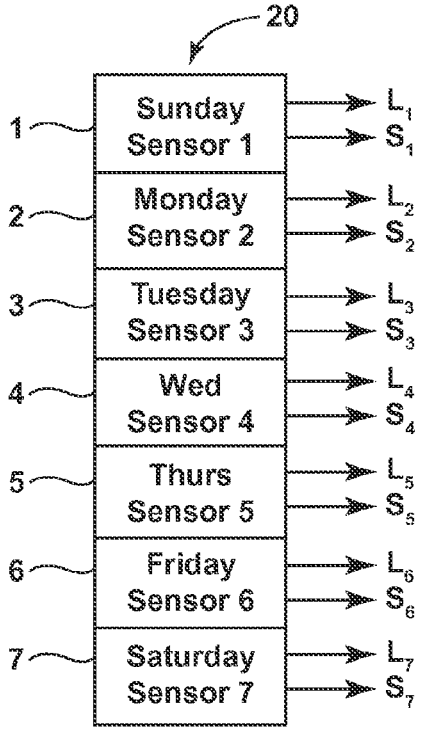
FIG. 4 is a schematic view of a sensor array according to an illustrative embodiment.

FIG. 4 schematically shows the output signals $S_1 \ldots S_7$ produced by the respective sensors 31 in each pill compartment 1-8, as well as signals $L_1 \ldots L_7$ generated by sensors 34. As illustrated in FIG. 5, these signals are supplied to a controller 41, which monitors the state of the signal ("1" or "0") to determine if, for example, a pill is present in a compartment or has been removed from a compartment. The "status" (full or empty) of all compartments 1-8 is stored in an internal register as described in more detail below, so that the controller 41 can compare a new state against an old state. In an illustrative embodiment, the controller 41 may be a microprocessor or microcontroller with suitable software stored in memory 43 to perform various functions and routines as described herein. In one embodiment, a suitable visual display 45 controlled by the controller 41 may also be provided.

In one illustrative embodiment, the system software and controller are configured to perform the operations reflected in the flow charts of FIGS. 6-9 as will now be described in further detail. Assume that the user needs to take medication once per day and chooses to take the medication around 8 PM.

The user opens all doors (8) thru (14) and fills compartments (1) thru (7) with the needed medication. According to FIG. 6, the controller 41 detects main button actuation (step 102) and then detects that all compartments are filled (step 103) and records the status of the doors (step 104). The controller 41 then enables either a "Locking Mode" of operation or a "Non-Locking Mode" of operation according to the user setting (test 105). The illustrative software functionality discussed hereafter is for the Non-Locking Mode. Further discussion is also presented below regarding the optional "Locking Mode" of operation.

Continuing the example, assume that Non Locking Mode is selected. A test 107 is performed to detect a main button actuation, which gives the user to option to step through a number of steps 108, 109, 110, 111, 112, 113, 114, 115, (FIGS. 6 & 7) which permit the user to reset the clock/day, the mode of operation, and various registers. Assuming no button press is detected at test 107, the flow proceeds to test for a door status change at test 118. If today is Wednesday, the user will open the door (11) which is labeled "W" around 8 PM, take the medication and close the door (11) again. Using the sensor and door switch signals $S_1 \ldots S_7$; $L_1 \ldots L_7$, the controller 41 will register that the medication is removed and it will log the time internally. Such operation is illustrated in steps 121, 122, 146, 124, 125 and 128 of the flowchart of FIGS. 7 & 8 where the controller 41 detects that the status of Register B1-7 has changed as compared to Register A1-7 (step 128). The controller 41 then proceeds through steps 130, and 132, or 132 and 136 to record the opening time "$T_0$" in memory Register G for today's day (steps 134 or 137, FIG. 9).

Figure 9:
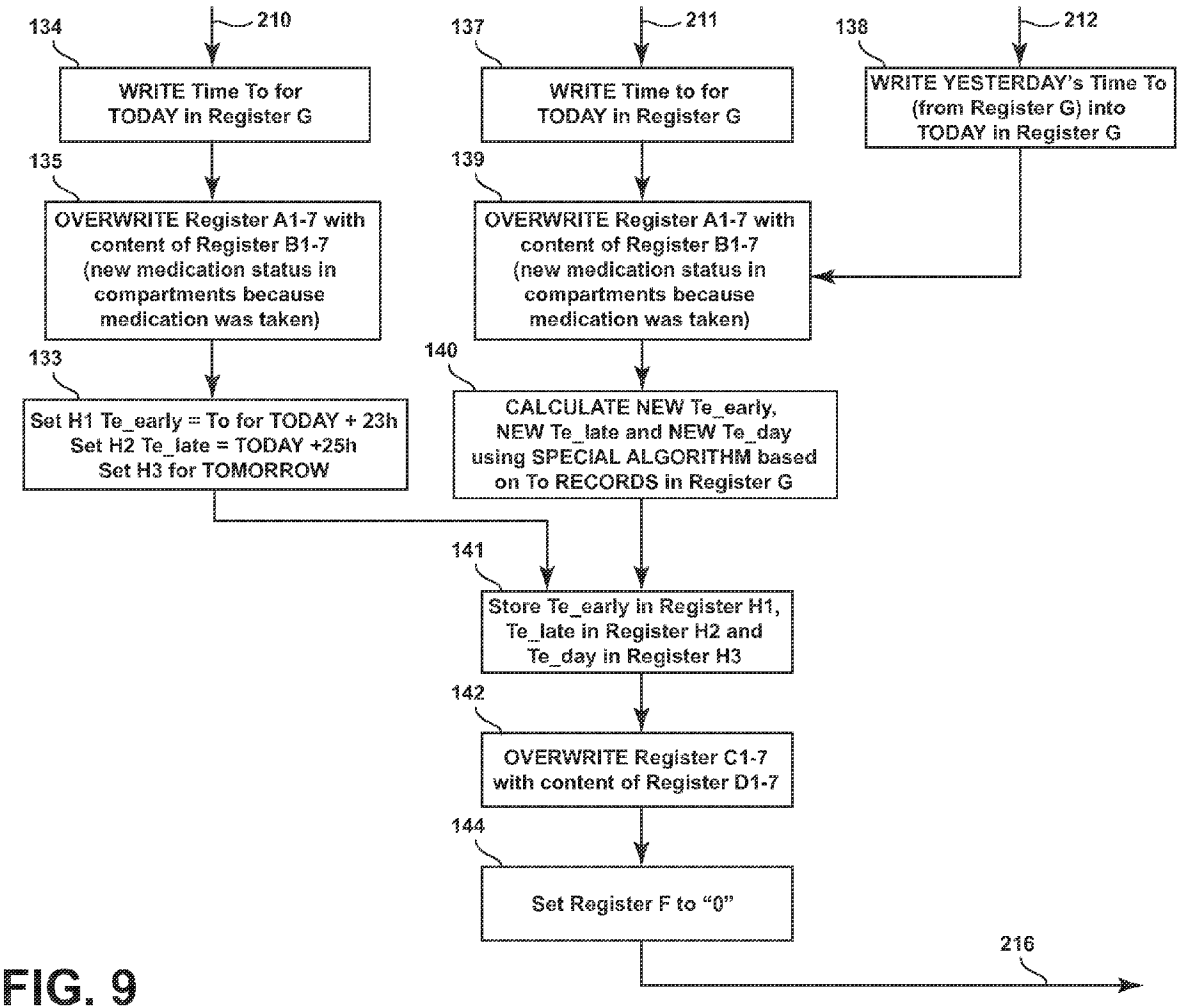
FIG. 9 is a continuation of the flow diagram of FIG. 8.

On the next day, if the user opens the door (12) labeled "T" and remove the medication at, for example, 8:20 PM, the device will mark this as a new time $T_0$ in Register G according to step 137 of the flowchart of FIG. 9. As illustrated at step 140 of FIG. 9, the learning algorithm then creates new estimated $T_e$_early and $T_e$_late time points for Friday based on various timestamps of the days before. In this example, the new estimated $T_e$_early time could be 7:10 PM and the new estimated $T_e$_late could be 9:10 PM, and the new $T_e$_day would be 06 (Friday).

More specifically, at test 136, the controller 41 tests to determine whether there are entries in register H1-2 for $T_e$_early or $T_e$_late, which define the range within which removal of a pill is considered to be timely. If the detected time "T" is within this range, the flow proceeds through steps 137, 139, 140, 141, 142, and 144 (FIG. 9). In step 139, Registers A1-7 are overwritten with the contents of Register B1-7 (new medication status in compartments because medication was taken). A new $T_e$_early and $T_e$_late are calculated in step 140 using a special algorithm applied to the records in Register G. An illustrative special algorithm is: Take the AVERAGE to from Registers G1-7, calculate a Standard Deviation for values in G1-7, then take $T_e$_early=T_average−(60 min*Standard Deviation) and $T_e$_late=T_average+(60 min*Standard Deviation) where $T_e$_early and $T_e$_late are no longer than 3 hours apart.

At step 141, the new $T_e$_early and $T_e$_late are stored in Registers $H_1$, $H_2$, and the $T_e$_day is stored in Register $H_3$. Finally, register F is set to "zero" in step 144. It will be noted that, if it is the first time through the flow, there will be no $T_e$_early or $T_e$_late set in Registers $H_1$ and $H_2$. Therefore, at test 132, the flow is directed through steps 134, 135, and 133, and then to step 141. Step 135 is the same as step 139, while step 133 sets $H_1$ and $H_2$ to $T_0$+23 h and $T_0$+25 h such that test 132 will be satisfied the next time through the procedure. Step 133 is performed in order to derive values for $T_e$_early and $T_e$_late based on only one previous record To. The simplest approach is to estimate that the next $T_e$ will be the same time as the previous $T_e$ plus or minus the variance. Allowing for +/−1 hour variance, the next $T_e$_early is today's $T_0$ plus 23 hours, and tomorrow's $T_e$_late is today's $T_0$ plus 25 hours. Put another way, TOMORROW'S $T_e$_early is identical to today's $T_0$ minus 1 hour, and tomorrow's $T_e$_late is identical to today's $T_0$ plus 1 hour, depends on which way you look at it.

Figure 7:
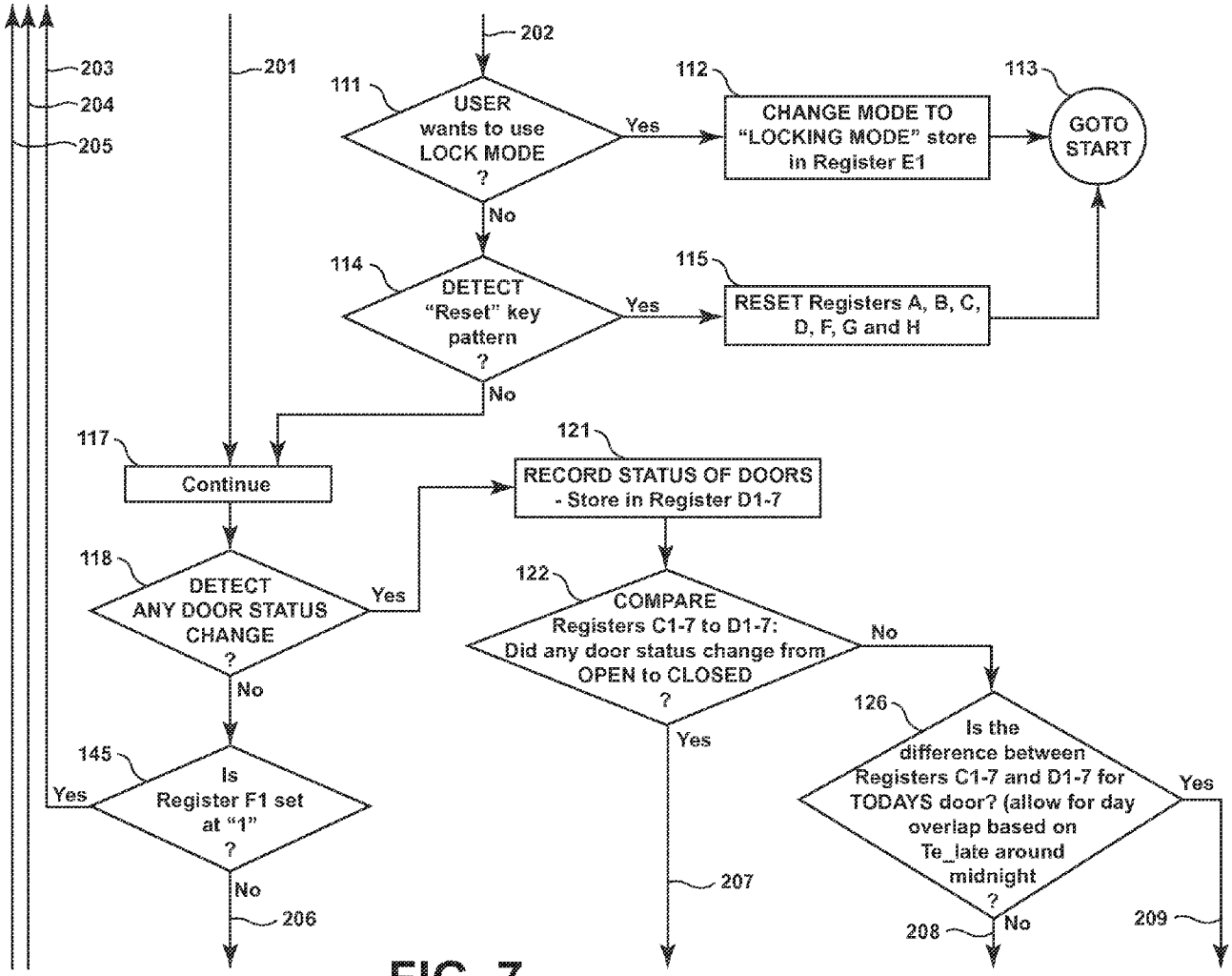
FIG. 7 is a continuation of the flow diagram of FIG. 6.
Figure 8:
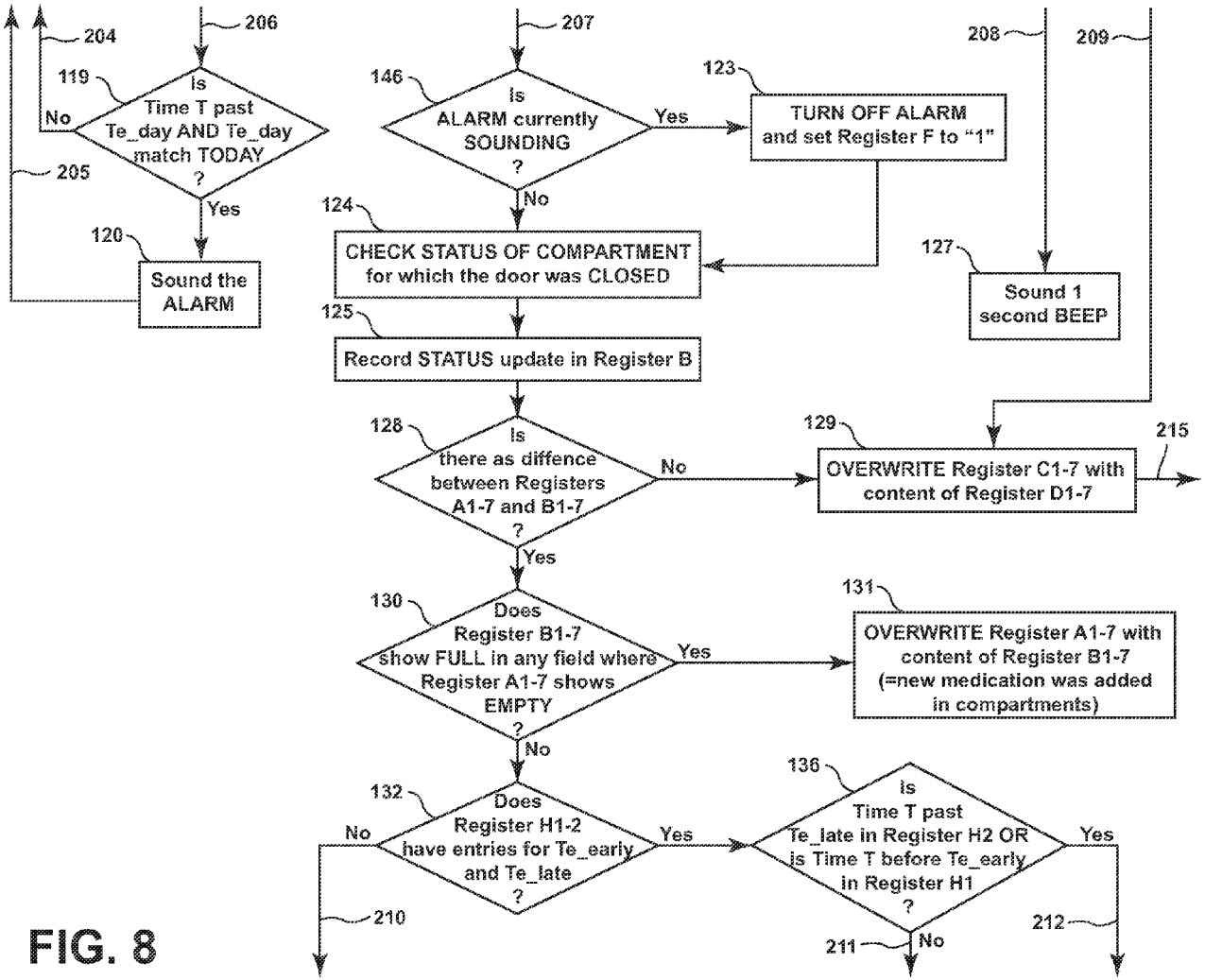
FIG. 8 is a continuation of the flow diagram of FIG. 7.

If, on Friday ($T_e$_day=06), the device does not see Register D06 (lid status for Compartment labeled "F") changing state at steps 118, 145, and 119 of FIGS. 7 and 8 before the Time Clock goes past $T_e$_late in Register $H_2$, the device will begin sounding an alarm and/or give a vibrating alert as reflected in step 120 (FIG. 8) to indicate to the user that it is past time to take the mediation.

If, at test 122, it is determined that the door status did not change from "OPEN" to "CLOSED," steps 126, 127, and 129 (FIGS. 7 & 8) may be performed. At test 126, it is determined whether the difference between Registers C1-7 and D1-7 is for Today's door. If not, an alarm ("beep") is sounded and the contents of C1-7 are overwritten with the contents of D1-7 at step 129. This step is performed because, in the next procedure loop, the controller 41 needs to be able to detect the next change in door status, so it will need to overwrite C1-7 with D1-7 because it can only detect these changes by comparing C1-7 with D1-7. If the result of test 126 is "yes", no "beep'" is sounded and step 129 is still performed. Note that step 129 is also performed as a result of a negative determination at test 126 and a positive determination at test 130, after overwriting Register A1-7 with B1-7 at step 131.

In one embodiment, the Audible Reminder (Alarm) is turned off if the user opens and closes a compartment door (Step 123—FIG. 8). At this point, the device 20 will not sound the alarm again until there is a NEW $T_e$_early and $T_e$_late and $T_e$_day in Register H1-3 and the Time Clock is past the time and day set in Registers H2 and H3. If the user takes the medication past $T_e$_late, that day's $T_0$ time stamp will be disregarded for the learning cycle and instead $T_0$ from the previous day will be recorded for that day.

Those skilled in the art will appreciate that there are many different ways to create the functionality shown in the Flowcharts of FIGS. 6-9. Reviewing the operation described above in conjunction with those flowcharts, a number of functional aspects may be noted:

1. The functionality includes checking door status before checking compartment status to save on battery power.
2. Upon startup, the device 20, and in particular, controller 41 in the illustrative embodiment, checks the status of all compartments (Full=1, Empty=0) and stores these in Register A1-7 and a copy in Register B1-7.
3. Upon startup, the controller 41 checks the status of all compartments (Open=1, Closed=0) and stores these in Register C1-7 and a copy in Register D1-7.
4. In a device, the controller 41 checks which mode is selected in Register E1 and if E1=1, device will LOCK the doors that are closed above a full compartment.
5. The controller 41 always checks for door movement (a simple door switch is very battery friendly) as compared to constantly scanning the contents of the compartments (very battery unfriendly).
6. The first day the user will open a door at the appropriate time and remove his medication. The controller 41 will record the status of all doors in Register D1-7 and compare to Register C1-7. If the controller 41 recognizes the door closing again, it will scan the compartment and update Register B. By comparing Register B (new status) to Register A (old status) the controller 41 can see if medication was removed and it will then calculate a new $T_e$_early, $T_e$_late and $T_e$_day which are stored in Registers H1-3. Then the controller 41 will overwrite C1-7 with D1-7 values, and overwrite A1-7 with B1-7 values. These overwrites enable the controller to detect new changes in door status and compartment status.

7. Going forward, when the controller 41 senses or detects a door open, it will record the door status in Register D. It will then compare Register D1-7 to Register C1-7 and SOUND a BEEP at the user if the door is the wrong one for the day (based on value in Register H3). The controller 41 then overwrites Register C1-7 with Register D1-7, values which allow the controller to recognize new door movement again.
8. When a door is closed after being opened, the controller 41 will scan the particular compartment, and will update Register B for this compartment, and, if medication is added, will overwrite Register A1-7 with the values of Register B1-7. If medication is removed, the controller 41 will proceed with calculating new values for Te_early, Te_late and Te_day which will be updated in Registers H1-3. The controller will also overwrite Register C1-7 with Register D1-7 values so that it can recognize door movement again.
9. If the controller 41 does not recognize door movement by the time the internal Time Clock passes $T_e$_late on $T_e$_day, the controller checks Register F1 if the alarm has sounded before. If F1=1, no alarm will sound, and the controller 41 will continue monitoring. If F1=0, then the alarm will sound until the user opens and closes ANY door (see flowchart). This will then set F1=1 and the alarm will not sound again until there is a new value for $T_e$_early, $T_e$_late and $T_e$_day in Registers H1-3.

10. If medication is removed after $T_e$_late on $T_e$_day before $T_e$_early on $T_e$_day, then the current time T will not be recorded for T0 in Today's field in Register G. Instead, yesterday's value for $T_0$ will be copied into Today's field in Register G.

Those skilled in the art will appreciate that the various "Registers" described above may be located in various memory locations. In an illustrative embodiment, the Registers are internal memory registers in a selected microcontroller.

In one embodiment, the device 20 expects the compartments to be emptied in a particular order, for instance starting on Tuesday: On Tuesday compartment (3), on Wednesday compartment (4), on Thursday compartment (5), on Friday compartment (6), on Saturday compartment (7), on Sunday compartment (1), on Monday, compartment (2), etc. If a user skips a compartment accidentally, the device will still log the time To in Register G and calculate a new $T_e$_early and $T_e$_late and $T_e$_day.

In one embodiment, device has a removable battery 19 which can be replaced when needed. A low battery reminder with a flashing LED may also be provided. In one embodiment, removing the battery 19 will not delete the program stored in memory 43 since a built-in capacitor is provide to supply voltage to the internal clock of the controller 41 long enough to allow for a battery change. Leaving the battery out for a longer period will erase the user data and the unit will behave as it did when new from the factory.

In various embodiments, software for implementing the disclosed processes, procedures and functionality described above may be stored on various forms of computer readable medium or media or computer readable storage medium or media. For the purposes of this disclosure, a computer readable medium stores computer data, which data can and typically does include computer program code that is executable by a computer, in machine readable form. By way of example, and not limitation, a computer readable medium may comprise computer readable storage media, for tangible or fixed storage of data, or communication media for transient interpretation of code-containing signals. Computer readable storage media, as used herein, refers to physical or tangible storage (as opposed to signals) and includes without limitation volatile and non-volatile, removable and non-removable storage media implemented in any method or technology for the tangible storage of information such as computer-readable instructions, data structures, program modules or other data. Computer readable storage media includes, but is not limited to, RAM, ROM, EPROM, EEPROM, flash memory or other solid state memory technology, CD-ROM, DVD, or other optical storage, magnetic cassettes, magnetic tape, magnetic disk storage or other magnetic storage devices, or any other physical or material medium which can be used to tangibly store the desire information or data or instructions and which can be accessed by a computer or processor. In various embodiments, when suitable computer program code is loaded into and executed by a computer, the computer becomes a specially configured apparatus.

In one embodiment, the user can factory reset the device 20 by selecting the "RESET" option in the key menu system. Additionally, a locking mode can be provided as noted above and a procedure similar to that of FIGS. 6 to 9 and items 1-10 can be implemented to control operation of the device. The "Locking Mode" is technically simpler than the "Non-Locking Mode" since it prevents the user from opening any door, except for after Te_early on day Te_ay at which time that day's door will be unlocked. The device will keep doors above empty compartments unlocked to make refilling easy. After noting contents in any compartment, the device will lock the corresponding door.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A medication dispenser apparatus comprising:

a plurality of compartments, one for each day of the week;

a cover on each compartment configured to be openable and closable to enable insertion of medication into each respective compartment;

a sensor in each compartment configured to generate a first plurality of sensor signals signaling that medication is present or not present in each compartment;

a controller supplied with said first plurality of sensor signals and configured to alert a user if the medication in a compartment is not removed within a selected time interval;

wherein said selected time interval comprises a range about a target time; and wherein said controller is further configured to adjust the target time and range based on the pattern of usage of the medication.

2. The medication dispenser apparatus of claim 1 further comprising a plurality of second sensors configured to generate a second plurality of sensor signals indicating whether the door of a compartment is open or closed.

3. A tangible computer readable storage medium or media having non-transitory computer software stored thereon, which when executed by one or more computer processors, microprocessors, or microcontrollers is operable to perform a plurality of operations comprising:

detecting whether medication is present in a compartment of the medication dispenser; and causing an alert to be generated to alert a user if medication in the compartment is not removed within a selected time interval;

wherein said selected time interval comprises a range about a target time; and wherein said operations further comprise monitoring the usage pattern of the medication and adjusting said target time and range in response to said usage pattern.

4. The storage medium or media of claim 3 wherein said plurality of operations further comprises detecting the opening of a door of the medication dispenser.

* * * * *